US005600349A

United States Patent [19]

Keefe

[11] Patent Number: 5,600,349

[45] Date of Patent: Feb. 4, 1997

[54] METHOD OF REDUCING DRIVE ENERGY IN A HIGH SPEED THERMAL INK JET PRINTER

[75] Inventor: Brian J. Keefe, Stanford, Calif.

[73] Assignee: Hewlett-Packard Company, Palo Alto, Calif.

[21] Appl. No.: 394,927

[22] Filed: Feb. 24, 1995

Related U.S. Application Data

[63] Continuation of Ser. No. 14,301, Feb. 5, 1993, abandoned.

[51] Int. Cl.[6] ..... B41J 2/05

[52] U.S. Cl. ..... 347/11; 347/15; 347/57

[58] Field of Search ..... 347/11, 15, 57

[56] References Cited

U.S. PATENT DOCUMENTS

| | | | |
|---|---|---|---|
| 4,503,444 | 3/1985 | Tacklind | 347/11 |
| 4,513,299 | 4/1985 | Lee | 347/11 X |
| 5,285,215 | 2/1994 | Liker | 347/11 |

FOREIGN PATENT DOCUMENTS

| | | | |
|---|---|---|---|
| 0115180 | 8/1984 | European Pat. Off. | B41J 3/04 |
| 0124190 | 11/1984 | European Pat. Off. | B41J 3/04 |
| 0147575 | 7/1985 | European Pat. Off. | B41J 3/04 |
| 011169 | 1/1983 | Japan | B41J 3/04 |

OTHER PUBLICATIONS

Patent Abstracts of Japan, vol. 7, No. 85 (M–206) 9 Apr. 1983 & JP–A–58 011 169 (Canon Kabushiki Kaisha) 21 Jan. 1983.

European Search Report, Feb. 22, 1995, re Application 94300396.2.

*Primary Examiner*—Joseph W. Hartary

[57] ABSTRACT

A thermal ink jet printer including a printhead having a plurality of ink drop firing resistors responsive to ink drop firing pulse groups wherein a pulse group includes one or more pulses sufficiently closely spaced to produce respective droplets which merge in flight to form an ink drop whose volume depends on the number of pulses in the pulse group. The pulses in a pulse group are controlled such that the energy of the second and successive pulses is less than the energy of the first pulse. The intervals between leading edges of the pulses in a pulse group can be constant or reduced such that the intervals between adjacent pulses beginning with the second pulse is less than the interval between the leading edges of the first and second pulses.

10 Claims, 4 Drawing Sheets

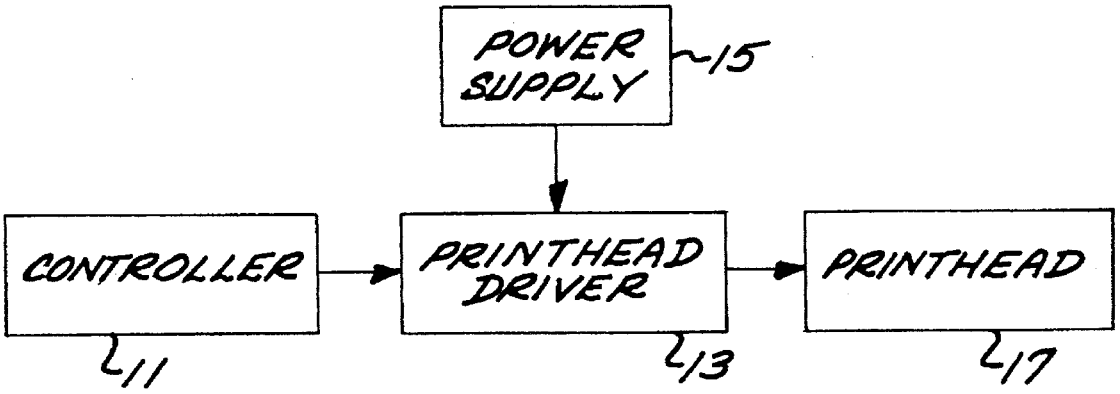
FIG. 1
FIG. 2
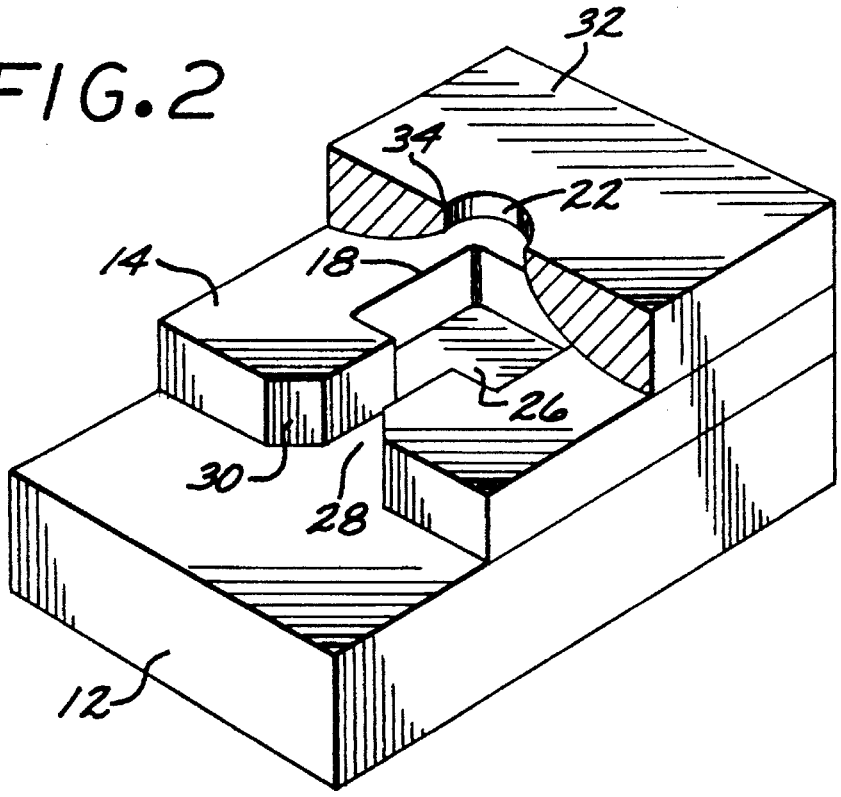

METHOD OF REDUCING DRIVE ENERGY IN A HIGH SPEED THERMAL INK JET PRINTER

CROSS REFERENCE TO RELATED APPLICATION(S)

This is a continuation of application Ser. No. 08/014,301 filed on Feb. 5, 1993, now abandoned.

BACKGROUND OF THE INVENTION

The subject invention relates generally to thermal ink jet printers, and is directed more particularly to a technique for reducing drive energy in thermal ink jet printheads while maintaining consistently high print quality.

An ink jet printer forms a printed image by printing a pattern of individual dots at particular locations of an array defined for the printing medium. The locations are conveniently visualized as being small dots in a rectilin-ear array. The locations are sometimes "dot locations", "dot positions", or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

Thermal ink jet printheads commonly comprise an array of precision formed nozzles, each of which is in communication with an associated ink containing chamber that receives ink from a reservoir. Each chamber includes a thermal resistor which is located opposite the nozzle so that ink can collect between the thermal resistor and the nozzle. The thermal resistor is selectively heated by voltage pulses to drive ink drops through the associated nozzle opening in the orifice plate. Pursuant to each pulse, the thermal resistor is rapidly heated, which causes the ink directly adjacent the thermal resistor to vaporize and form a bubble. As the vapor bubble grows, momentum is transferred to the ink to be propelled through the nozzle and onto the print media.

For gray scale printing, wherein the darkness of each printed dot is varied, it is known to vary the volume of ink in each drop that produces a printed dot. For example, commonly assigned U.S. Pat. No. 4,503,444 for "METHOD AND APPARATUS FOR GENERATING A GRAY SCALE WITH A HIGH SPEED THERMAL INK JET PRINTER," incorporated herein by reference, discloses a thermal ink jet printer wherein each drop is formed pursuant to a pulse group applied to a resistor which causes emission of a packet of droplets that merge in flight to form a single drop.

A consideration with the operation of thermal ink jet printheads with drop forming pulse groups is increased printhead operating temperatures due to multiple firings for each pixel. This consideration becomes more notable with small drop volume thermal ink jet devices which require relatively higher input energy per unit flow of ink, and thus develop higher operating temperatures as a result of the increase in average power.

High operating temperatures are known to cause degradation in print quality due to induced variability in printhead performance parameters such as drop volume, spray, and trajectory. Moreover, when the operating temperature of a thermal ink jet printhead exceeds a critical temperature, it becomes inoperative. Also, the operating lifetime of a thermal ink jet printhead can be reduced as a result of excessive heat build up.

A common technique for reducing heat build up is to operate at lower resistor firing frequencies, which delivers lower average power to the printhead. However, reducing the maximum resistor firing frequency also reduces printing speed and throughput.

SUMMARY OF THE INVENTION

It would therefore be an advantage to provide for thermal ink jet printhead operation that avoids performance degrading heat build up while maintaining high operating frequencies.

The foregoing and other advantages are provided by the invention in a greyscale thermal ink jet printer wherein the energy of the second and subsequent pulses in a drop forming pulse group are reduced to adjust for the lower required energy of nucleating a drive bubble.

BRIEF DESCRIPTION OF THE DRAWING

The advantages and features of the disclosed invention will readily be appreciated by persons skilled in the art from the following detailed description when read in conjunction with the drawing wherein:

FIG. 1 is a schematic block diagram of the thermal ink jet components for implementing the invention.

FIG. 2 is a schematic perspective view illustrating a portion of a printhead with which the disclosed invention can be implemented.

DETAILED DESCRIPTION OF THE DISCLOSURE

Figure 3:
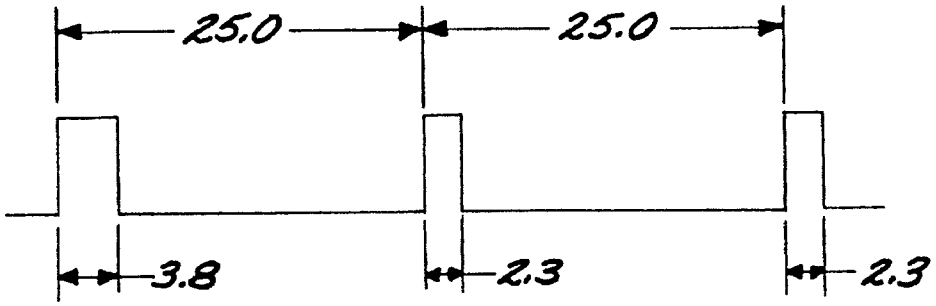
FIG. 3 is a pulse timing diagram illustrating the reduction of drive energy in accordance with one embodiment of the invention.

In the following detailed description and in the several figures of the drawing, like elements are identified with like reference numerals.

Referring now to FIG. 1, shown therein is a simplified block diagram of a thermal ink jet printer in which the disclosed invention can be implemented. A controller 11 receives print data input and processes the print data to provide print control information to a printhead driver 13. The printhead driver circuitry 13 receives power from a power supply 15 and applies driving or energizing pulses to ink drop firing resistors of a thermal ink jet printhead 17 which emit ink drops pursuant to the driving pulses.

The thermal ink jet printhead 15 is constructed in accordance with conventional printhead designs, and FIG. 2 shows by way of illustrative example a schematic partial perspective of an implementation of the printhead 15. The printhead of FIG. 2 includes a substrate member 12 upon which a polymer barrier layer 14 is disposed and configured in the geometry shown. The substrate 12 will typically be constructed of either glass or silicon or some other suitable insulating or semiconductor material which has been surface-oxidized and upon which a plurality of ink firing resistors 26 are photolithographically defined, for example in a layer of resistive material such as tantalum-aluminum. These ink firing resistors 26 are electrically connected by conductive trace patterns (not shown) which are used for supplying drive current pulses to these ink firing resistors during a thermal ink jet printing operation. In addition, there is also provided surface passivation and protection insulating layers (not shown) between the overlying polymer barrier layer 14 and the underlying ink firing resistors 26 and conductive trace patterns. Examples of thermal ink jet printhead construction are shown in the *Hewlett Packard Journal,* Volume 39, No. 4, August 1988, incorporated herein by reference, and also in the *Hewlett Packard Journal,* Volume 36, No. 5, May 1985, also incorporated herein by reference.

The polymer barrier layer 14 can be formed from a polymeric material using known photolithographic masking and etching processes to define firing chambers 18 which overlie respective heater resistors 26. The ends of an opening in the firing chambers 18 are connected to the sides of an ink feed channel 28 which extends as shown to receive ink at the slanted or angled lead-in end sections 30 that define an ink entry port of the polymer barrier layer 14. Thus, the firing chamber 18 is integrally joined to the rectangularly shaped ink feed channel 28 and associated ink flow entry port 30 which are operative to supply ink to the firing chamber 18 during drop ejection of ink from the thermal ink jet printhead.

An orifice plate 32 of conventional construction and fabricated typically of gold plated nickel is disposed as shown on the upper surface of the polymer barrier layer 14, and the orifice plate 32 has a convergently contoured orifice opening 34 therein which is typically aligned with the center of the ink firing resistor 26. However, in some cases the orifice opening 34 may be slightly offset with respect to the center of the ink firing resistor in order to control the directionality of the ejected ink drops in a desired manner.

The controller 11 of the thermal ink jet printer of FIG. 1 comprises, for example, a microprocessor architecture in accordance with known controller structures, and provides pulse data representative of the firing pulses for driving the individual ink drop firing resistors of the printhead 17. By way of illustrative example, the controller provides for each ink drop firing resistor pulse data representative of the number of pulses that the resistor is to be fired in each firing cycle, wherein a firing cycle is defined as a time interval during which each ink firing resistor and the printhead driver drives the ink firing resistors in accordance with the resistor pulse data such that the resistors are fired with the appropriate energizing pulses.

The ink jet printer of FIG. 1 provides for gray scale printing wherein each ink firing resistor is controlled to produce ink drops of varying volume (greater ink volume for darker print). In particular, each dot printing drop produced by the printhead is formed pursuant to a pulse group applied to an ink firing resistor wherein a pulse group includes one or more pulses each respectively causing the emission of corresponding one or more droplets. The pulses in a pulse group are sufficiently close together so that the ink droplets from the pulses within a pulse group merge together in flight to form the single ink drop prior to reaching the print medium. The time interval between pulse groups applied to any given ink firing resistor is sufficiently large to avoid merging of the drops from different pulse groups. The technique of using pulse groups to generate ink drops of varying volumes for gray scale applications is disclosed in the previously cited U.S. Pat. No. 4,503,444.

In accordance with the invention, each dot printing ink drop is formed pursuant application of a sequence of 1 to MAX pulses of a group pulse pattern that includes MAX pulses and wherein the energy of the second and subsequent pulses is less than the energy of the first pulse in the group pulse pattern. In one embodiment of the invention, the time interval between the leading edges of the pulses in a pulse group pattern remains constant. In another embodiment of the invention, the time interval between the leading edges of adjacent pulses in a pulse group is decreased starting with the second pulse (i.e., the pulse timing is advanced), and the energy of the second and subsequent pulses is constant and less than the energy of the first pulse. In a further embodiment of the invention, the time interval between the leading edges of adjacent pulses in a pulse group is decreased starting with the second pulse (i.e., the pulse timing is advanced), and the energy of the second and subsequent pulses is reduced relative to the energy of the first pulse such that the energy of the second pulse is less than the energy of the first pulse, the energy of the third pulse is less than the energy of the second pulse. The energy of ink firing pulses can be controlled, for example, by width or amplitude.

Referring now to FIG. 3 schematically illustrated therein is a group pulse pattern in accordance with a pulse width reduction embodiment of the invention wherein the pulse width of the second and successive pulses is constant and reduced relative to the width of the first pulse, and wherein the intervals between all pulses in the pattern are the same. For the particular example the maximum number of pulses MAX being three, a dot printing drop would be formed pursuant to a pulse group comprised of the first pulse, the first and second pulses, or all three pulses, wherein the number of pulses in a particular pulse group would depend upon the desired printed dot density. By way of illustrative example, the first pulse of the group pulse pattern has a width of 3.8 microseconds, while the second and third pulses each has a width of 2.3 microseconds, which is a pulse energy reduction of 39% relative to the first pulse. The time interval between the start of adjacent pulses is shown as 25 microseconds.

It should be appreciated that a pulse group pattern having a greater maximum number of pulses MAX can be utilized to obtain a greater number of print shades, wherein the second and subsequent pulses would be of the same pulse width, for example.

Figure 4:
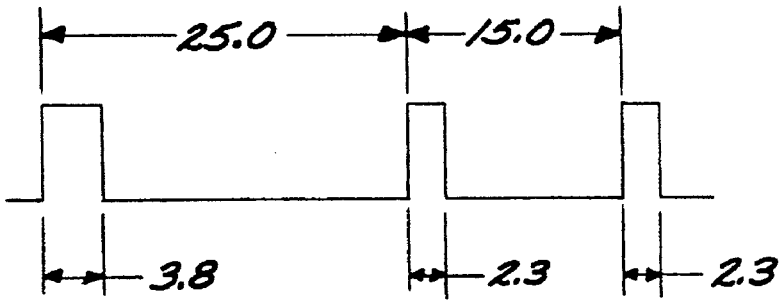
FIG. 4 is a pulse timing diagram illustrating the reduction of drive energy in accordance with another embodiment of the invention.

Referring now to FIG. 4, schematically illustrated therein by way of illustrative example is a pulse group pattern in accordance with a pulse width reduction and timing advance embodiment of the invention wherein the second and subsequent pulses have the same reduced width. For the particular example shown of a pulse group pattern having a maximum number of pulses MAX that is equal to three, a dot printing drop would be formed pursuant to a pulse group comprised of the first pulse, the first and second pulses, or all three pulses, wherein the number of pulses in a particular pulse group would depend upon the desired printed dot density. The first pulse has a width of 3.8 microseconds, and the second and third pulses each has a pulse width of 2.3 microseconds, which is a pulse energy reduction of 39% relative to the first pulse. The interval between the leading edges of the first and second pulses is 25 microseconds, and the interval between the leading edge of adjacent pulses starting with the second pulse is 15 microseconds.

It should be appreciated that a pulse group pattern having a greater maximum pulse count can be utilized to obtain a greater number of print shades, wherein the second and subsequent pulses would be of the same pulse width that is reduced relative to the first pulse and wherein the intervals between the leading edges of adjacent pulses starting with the second pulse is constant and less than the interval between the leading edges of the first and second pulses.

Figure 5:
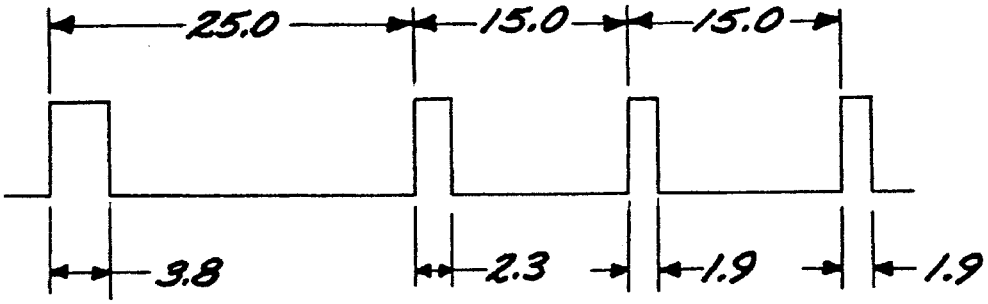
FIG. 5 is a pulse timing diagram illustrating the reduction of drive energy in accordance with a further embodiment of the invention.

Referring now to FIG. 5, schematically illustrated therein by way of illustrative example is a pulse group pattern in accordance with a pulse width reduction and timing advance embodiment of the invention wherein the width of the second pulse is reduced relative to the width of the first pulse, and the widths of the third and subsequent pulses are reduced relative to the width of the second pulse. For the particular example of a pulse group pattern having a maximum number of pulses MAX that is equal to four, a dot printing drop would be formed pursuant to a pulse group comprised of the first pulse, the first and second pulses, the first through third pulses, or all four pulses, wherein the number of pulses in a particular pulse group would depend upon the desired printed dot density. By way of illustrative example, the first pulse has a width of 3.8 microseconds, and the second pulse has a pulse width of 2.3 microseconds, which is a pulse energy reduction of 39% relative to the first pulse. The third and fourth pulses each has a width of 1.9 microseconds, which is a pulse energy reduction of 50% relative to the first pulse. The interval between the leading edges of the first and second pulses is 25 microseconds, and the interval between the leading of adjacent pulses starting with the second pulse is 15 microseconds.

It should be appreciated that a pulse group pattern having a greater maximum pulse count can be utilized to obtain a greater number of print shades, wherein the third and subsequent pulses would be of the same pulse width that is reduced relative to the first and second pulses and wherein the intervals between the leading edges of adjacent pulses starting with the second pulse is constant and less than the interval between the leading edges of the first and second pulses.

For the timing parameters in the examples of FIGS. 3–5, the interval between the end of one pulse group and the start of the next pulse group should be at least 45 microseconds to avoid in flight merging of the respective drops from the groups. Further, the pulse repetition interval within a group can be in the range of 15 to 45 microseconds.

Figure 6:
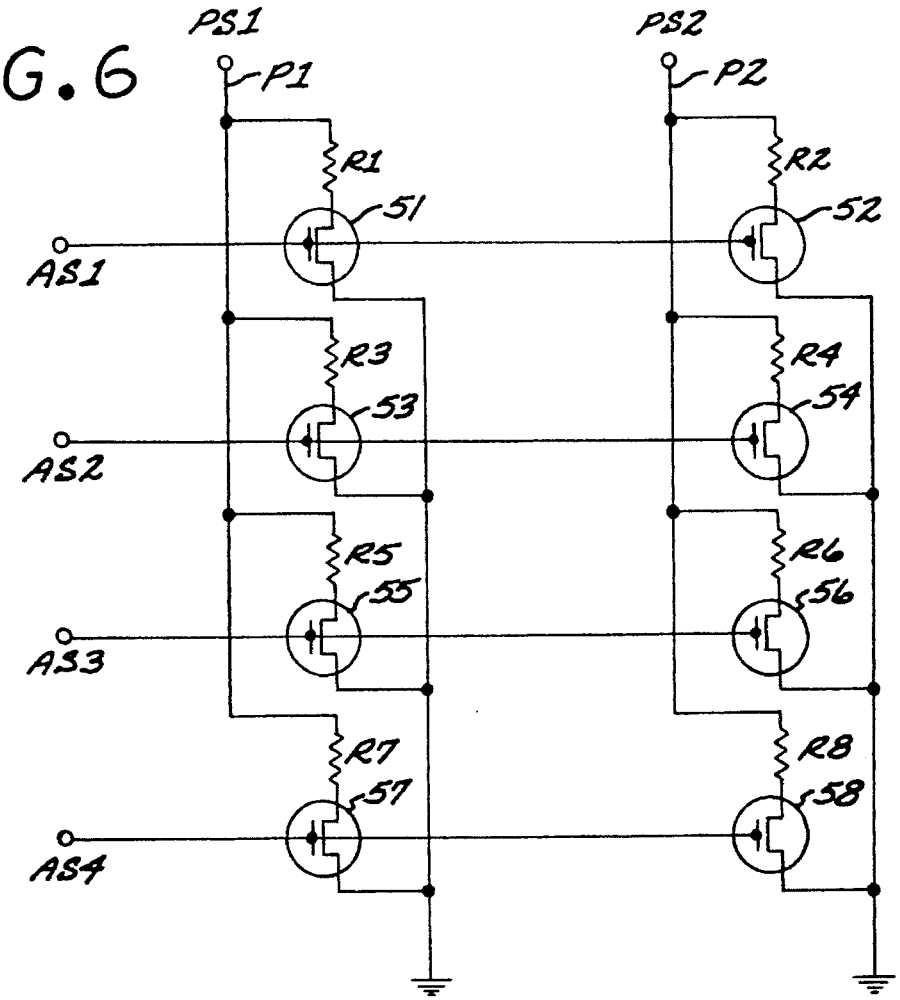
FIG. 6 is a schematic circuit diagram of the circuitry of a simplified printhead which is helpful in understanding the disclosed invention.
Figure 7:
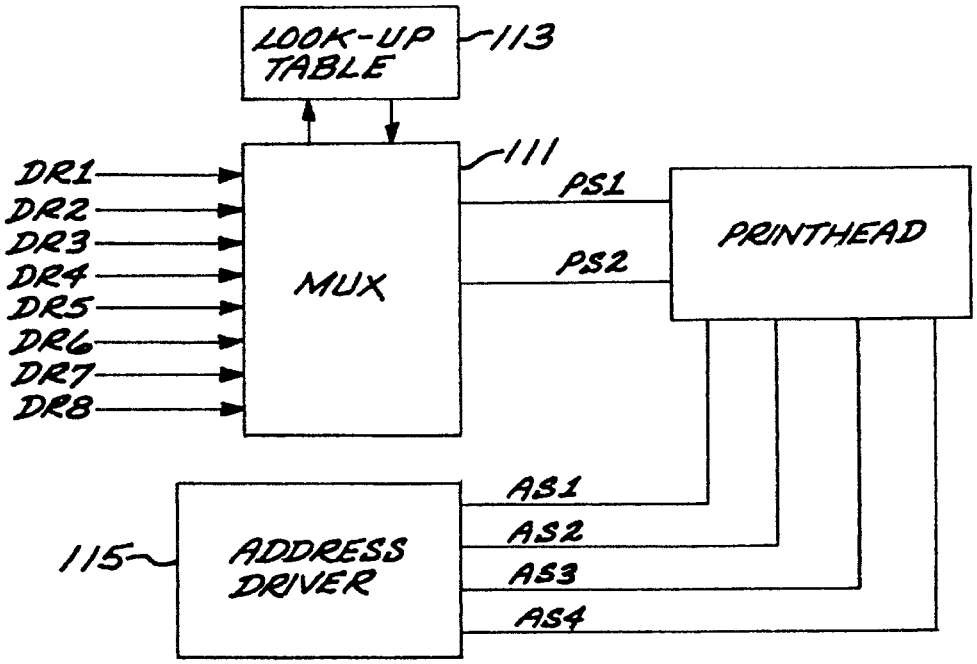
FIG. 7 is a block diagram illustrating components for driving the printhead circuit of FIG. 6 in accordance with the invention.

A thermal ink jet printer in accordance with the foregoing can be implemented in various ways including, for example, a multiplexed design as illustrated in simplified form in FIGS. 6 and 7. FIG. 6 is a simplified schematic circuit of a printhead having eight ink firing resistors R1 through R8 arranged in an array of 4 rows and 2 columns, and are driven by respective power FETs S1 through S8. The power FETs are controlled by address lines A1 through A4 and primitive select lines P1 and P2. In particular, the gates of the FETs in each row are commonly connected to an address line for that row; and resistors in each column are column are connected between the drains of respective FETs and a primitive select line for that column. Thus, when the address line of an ink firing resistor is at a logical high level, the resistor can be energized pursuant to the voltage on its primitive select line. As described more fully herein, the primitive select lines provide pulses for driving the ink firing resistors in accordance with the invention.

Figure 8:
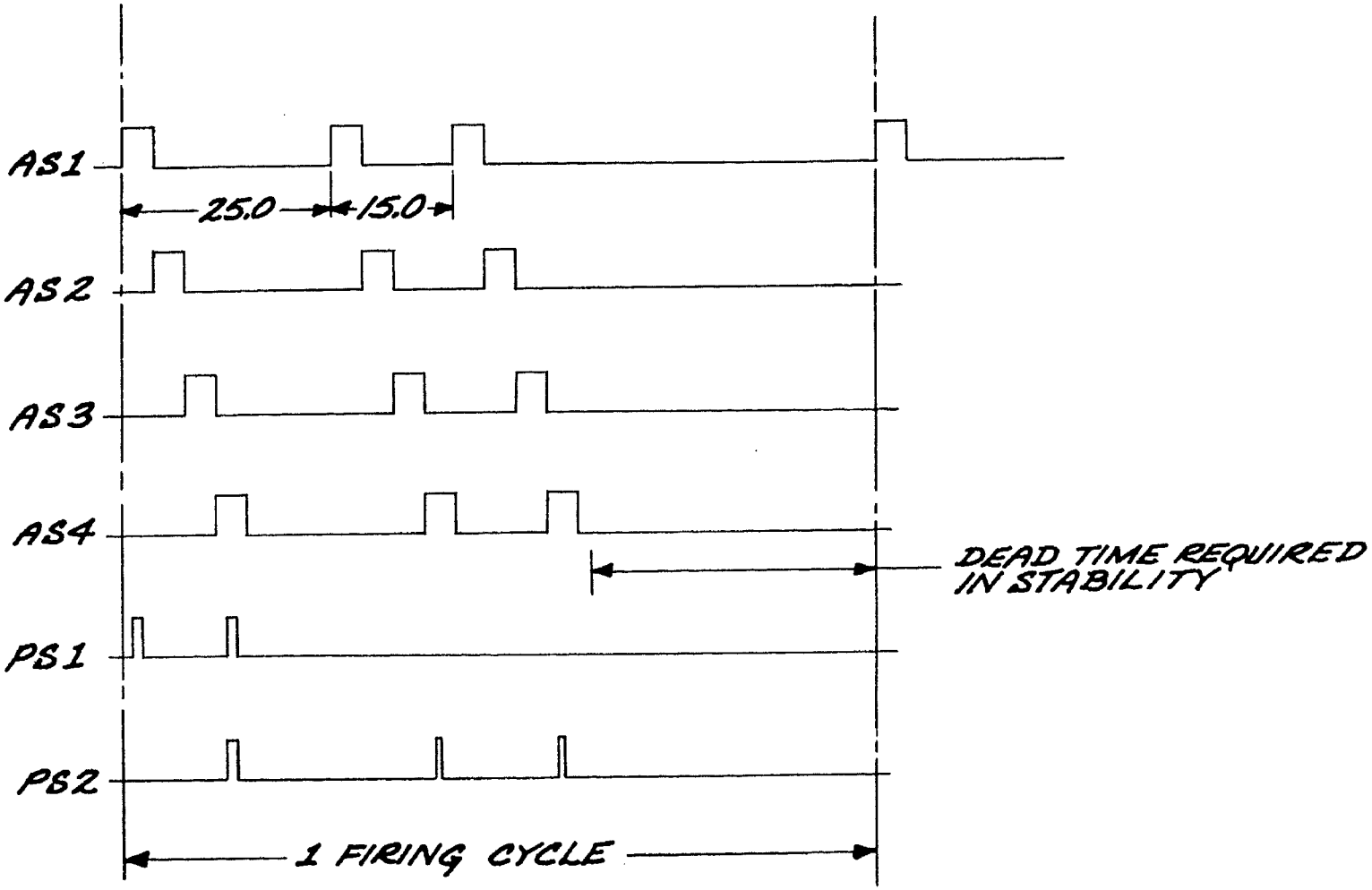
FIG. 8 is a timing diagram illustrating the operation of the printhead circuit of FIG. 6 in accordance with the invention.

FIG. 7 illustrates in simplified form, by way of illustrative example, a multiplexer 111, a look-up table 113, and an address driver 115 that would be implemented in the printhead driver 13 of FIG. 1 for driving the printhead of FIG. 4 in a multiplexed manner. The address driver 115 provides the address signals AS1 through AS2 on the address lines A1 through A4, wherein each address signal comprises a sequence of pulses that are the same in number as the number of pulses in the group pulse pattern utilized, and timed in accordance with the timing of the group pulse pattern being utilized, whereby the intervals between the leading edges of the pulses of an address signal is the same as the intervals between the leading edges of the pulses in the particular group pulse pattern being utilized. The widths of the pulses of each address signal are at least as wide as the corresponding pulses in the group pulse pattern, and the address signals are staggered relative to each other so that the address signal pulses are non-overlapping, as shown in FIG. 8 for a firing cycle for an implementation using a group pulse pattern as shown in FIG. 4 and described above. As utilized herein, a firing cycle is an interval during which each of the ink firing resistors of the printhead circuit of FIG. 6 is enabled pursuant to the address lines to produce a dot printing drop. Of course, whether an ink firing resistor fires a drop depends on the print data.

The multiplexer 111 receives respective pulse data DR1 through DR8 for each resistor on eight input lines, and provides two primitive select signals PS1 and PS2 on the primitive select lines P1 and P2. For the example of a group pulse pattern having four greyscale levels including white (i.e., a group pulse pattern having three pulses), the data for each resistor two bits for each firing cycle. The resistor data for each firing cycle is translated into pulse waveforms via the look-up table and amplified to provide the primitive select signals PS1 and PS2 which includes pulses of appropriate power for energizing the ink firing resistors that receive the pulses. In particular, each primitive select signal contains the pulses for all of the resistors in the column associated with the particular primitive select signal, and the pulses for each resistor are timed to coincide with the address signal pulses for that resistor. Since the address signals AS1 through AS4 are staggered, the primitive select pulses for the resistors in each column will be interleaved such that the resistors in each column will be energized in an interleaved manner wherein only one resistor in each column is being fired at any point in time during a firing cycle. In other words, resistors in a column cannot be concurrently energized. However, different resistors in different columns can be energized at the same time since each address signal controls a resistor in each column. FIG. 8 schematically illustrates the pulses provided by the primitive select signals during a firing cycle for the particular example of DR1=1, DR7=1, DR8=3, and the each of the remaining resistor data values being 0. For such example, as indicated on FIG. 8, PS1 contains the single pulses for the resistors R1 and R7, while PS2 contains the three pulses for the resistor R8.

The foregoing multiplexed scheme generally provides address signals that define for each row of resistors the times when such resistors can be energized, and the power primitive select signals provide the appropriate power pulses in accordance with the number of pulses of the group pulse pattern specified for each of the resistors. The address signals are staggered such that in each column only one resistor is energized at any given time, and the pulses in each of the primitive select signals are interleaved so that the pulses for each resistor in each column are coincident with the address pulses for such resistor.

It will be appreciated by persons skilled in the art that the selection of timing parameters including pulse energy reduction and timing advance will depend on the characteristics of the particular thermal ink jet printer. For example, the amount of pulse energy reduction will vary depending upon pulse timing, with the potential for pulse energy reduction increasing as the interval between pulses in a group pattern decreases, and pulse timing advance is chosen to optimize drop stability and linearize the grey-scale levels.

Pursuant to the invention, bulk temperature is reduced and local temperatures of the ink firing resistors are also, which advantageously allows for higher operating frequencies and produces improved print quality.

Although the foregoing has been a description and illustration of specific embodiments of the invention, various modifications and changes thereto can be made by persons skilled in the art without departing from the scope and spirit of the invention as defined by the following claims.

What is claimed is:

1. A thermal ink jet printer system comprising:

a thermal ink jet printhead having a plurality of ink drop firing resistors responsive to ink droplet firing pulses; and control means for applying to a selected one of said ink firing resistors at least a first in sequence pulse of a pulse group pattern having a sequence of pulses that cause firing of respective ink droplets when applied to the selected ink firing resistor, said pulses being sufficiently closely spaced in time by time intervals so that the droplets fired pursuant thereto combine in flight to form a single drop having a volume that depends on the number of pulses of the pulse group that are applied, said control means controlling the pulses of the pulse group such that the drive energy for the second and subsequent pulses in the pulse group is reduced relative to the drive energy of the first pulse of the pulse group and such that each of the pulses of the pulse group has a pulse width that is less than any of the time intervals between the pulses of the pulse group, whereby heat build up in the thermal ink jet printhead is reduced as a result of the reduced drive energy of the second and subsequent pulses of the pulse group.

2. The thermal ink jet printer of claim 1 wherein said second and subsequent pulses have a constant energy.

3. The thermal ink jet printer of claim 1 wherein said control means reduces the energy of a third pulse and a fourth pulse relative to the energy of the second pulse, said third and fourth pulses having a constant energy.

4. The thermal ink jet printer of claim 3 wherein the interval between the leading edges of adjacent pulses starting with the second pulse is decreased relative to the interval between the leading edges of the first and second pulses.

5. The thermal ink jet printer of claim 1 wherein said control means reduces the pulse width of the second and any subsequent pulses relative to the pulse width the first pulse.

6. The thermal ink jet printer of claim 5 wherein said second and subsequent pulses have a constant pulse width.

7. The thermal ink jet printer of claim 6 wherein the pulse width of said second and subsequent pulses is about 60% of the width of the first pulse.

8. The thermal ink jet printer of claim 5 wherein said control means reduces the pulse width of a third pulse and a fourth pulse relative to the width of the second pulse, said third and fourth pulses having a constant pulse width.

9. The thermal ink jet printer of claim 8 wherein the interval between the leading edges of adjacent pulses starting with the second pulse is decreased relative to the interval between the leading edges of the first and second pulses.

10. The thermal ink jet printer of claim 9 wherein said second pulse has a pulse width of about 60% of the width of the first pulse, and wherein said third and any subsequent pulse have a pulse width of about 50% of the width of the first pulse.

* * * * *